US008955482B2

(12) United States Patent
Meyer

(10) Patent No.: US 8,955,482 B2
(45) Date of Patent: Feb. 17, 2015

(54) LOST MOTION RECIPROCATION SPLITTER

(71) Applicant: Ken Meyer, Fridley, MN (US)

(72) Inventor: Ken Meyer, Fridley, MN (US)

( * ) Notice: Subject to any disclaimer, the term of this patent is extended or adjusted under 35 U.S.C. 154(b) by 161 days.

(21) Appl. No.: 13/895,358

(22) Filed: May 16, 2013

(65) Prior Publication Data

US 2014/0338621 A1 Nov. 20, 2014

(51) Int. Cl.
*F01L 1/18* (2006.01)

(52) U.S. Cl.
CPC ..... *F01L 1/182* (2013.01)
USPC ..... 123/90.41; 123/90.39

(58) Field of Classification Search
USPC ..... 123/90.41, 90.39, 90.16
See application file for complete search history.

(56) References Cited

U.S. PATENT DOCUMENTS 6,659,053 B1 * 12/2003 Cecur ..... 123/90.16

* cited by examiner

*Primary Examiner* — Zelalem Eshete

(57) ABSTRACT

A driver that reciprocates has its reciprocation divided into a non-actuating portion and an actuating portion. The driver in one embodiment positions a carrier that has two pins, each pin being slidably mounted in its slot on a housing. One of the pins is an output pin that may be linked to operatively position a valve of an internal combustion engine. The two slots are configured such that each pin, during its motion range, does effect a capture of the other pin such that the captured pin is generally stationary. When the output pin is captured, the driver reciprocation causes the non-output pin to perform a lost-motion traverse of its slot. When the non-output pin is captured, the driver reciprocation actuates the output pin. A linked pair of such embodiments driven by a single driver can thus alternately actuate two valves.

12 Claims, 8 Drawing Sheets

FIG. 7
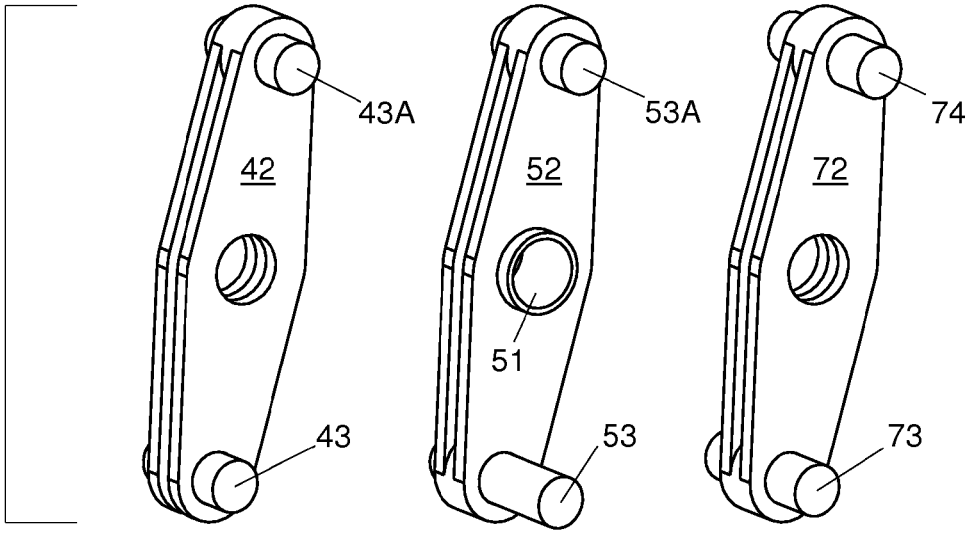
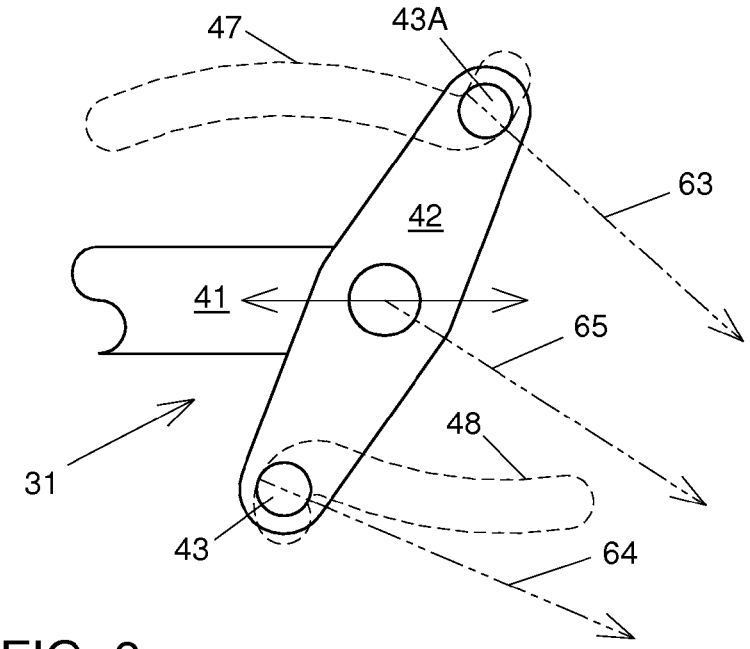
FIG. 8

LOST MOTION RECIPROCATION SPLITTER

TECHNICAL FIELD

The present disclosure pertains to lost motion actuators that transform a reciprocating input into an active output component and an inactive component, particularly with application to valve actuation of internal combustion engines.

BACKGROUND

Internal combustion engines typically employ valves to ventilate their cylinders during operation. Each such valve is opened during only a portion of the engine's revolution, the actuation of a given valve alternating with that of at least one other valve. Though the fact of this alternating actuation suggests the use of common linkages to simplify the engine's mechanical system, the valves typically are driven separately. Manufacturing expense and operating wear and friction is thus incurred that drives up the cost of engine operation. Furthermore, the numerous parts in such valve trains produce cylinder head crowding.

Foertsch, in U.S. Pat. No. 1,690,222, teaches an axial cam drive system that greatly simplifies valve actuation for its engine. One rod linked to a cam follower drives the intake and exhaust valves for a cylinder, actuating them alternately. Yet this system involves kinetic impact between a driving member and its contact face, which produces excessive noise and mechanical deterioration. Smietana, in U.S. Pat. No. 5,231,959, teaches hydraulic actuation of an engine's valves. One hydraulic mechanism is required for each valve, which incurs expense at manufacture and in maintenance Valve actuation drivers are known in the art that deliver to their systems a sinusoidal reciprocating stroke, which stroke must be truncated to produce a desired period of valve opening. Such systems suffer from the necessarily short useful stroke that their drivers produce.

According to an aspect of the present disclosure, a driver's reciprocating stroke is divided into an output-actuating portion and a non-actuating portion while avoiding mechanical impact during operation between moving and stationary members. The reciprocating stroke of one driver may actuate two valve stations alternately, allowing for fewer mechanical components and reduction of friction and wear. The output of a typical embodiment has an actuated distance that is roughly twice that of the actuating distance of its driver.

BRIEF DESCRIPTION OF THE DRAWINGS

FIG. 7 is a side-by-side comparison of selected members from FIGS. 1, 2, and 9.

FIG. 8 is an isolated side view of the FIG. 3 members, with geometry trace lines illustrated.

DETAILED DESCRIPTION OF THE DRAWINGS

Figure 1:
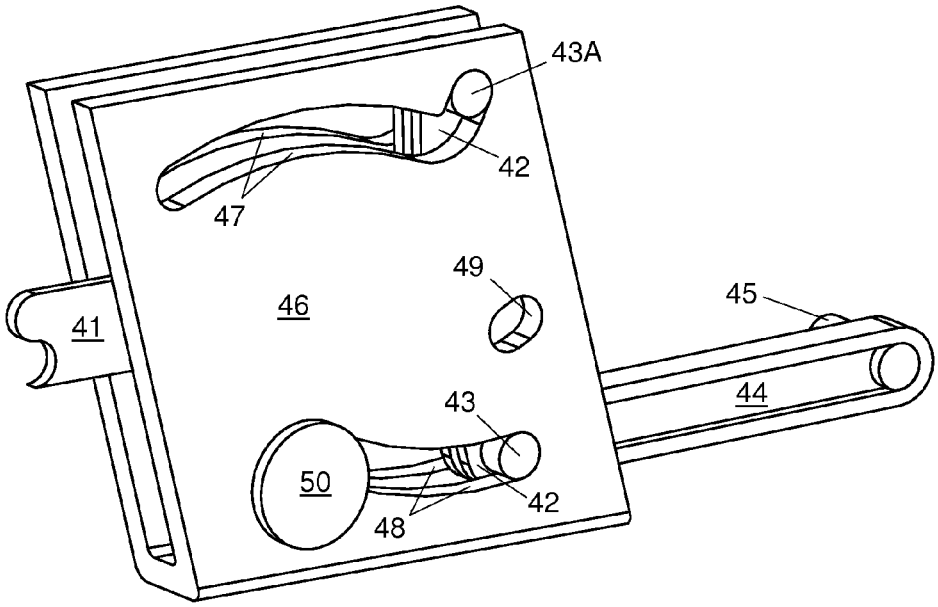
FIG. 1 is a perspective of an end-driven splitter at full actuation.

FIG. 1 shows an end-loading "splitter" at fully-actuated position. Included are: a housing 46 with two slots 47, two slots 48 and two positioning slots 49; two disks 50; internal members driver 41, carrier 42, output pin 43, and idler pin 43A; and an arm 44 with a gudgeon 45 fixed to it. Output pin 43 is slidably mounted in slots 48, and idler pin 43A is slidably mounted in slots 47. Disks 50 are coaxial and fixed to external faces of housing 46, which is symmetric about a plane centered between and parallel to its largest faces. Housing 46 is rotatably mounted in a frame (not shown) about disks 50, and is positioned with respect to the frame by a linkage (not shown) into one positioning slot 49. The linkage may be controlled by means known in the art, such as by a servomotor. Slots 47 include a major portion that arcs about a position in slots 48, and slots 48 include a major portion that arcs about a position in slots 47.

Figure 2:
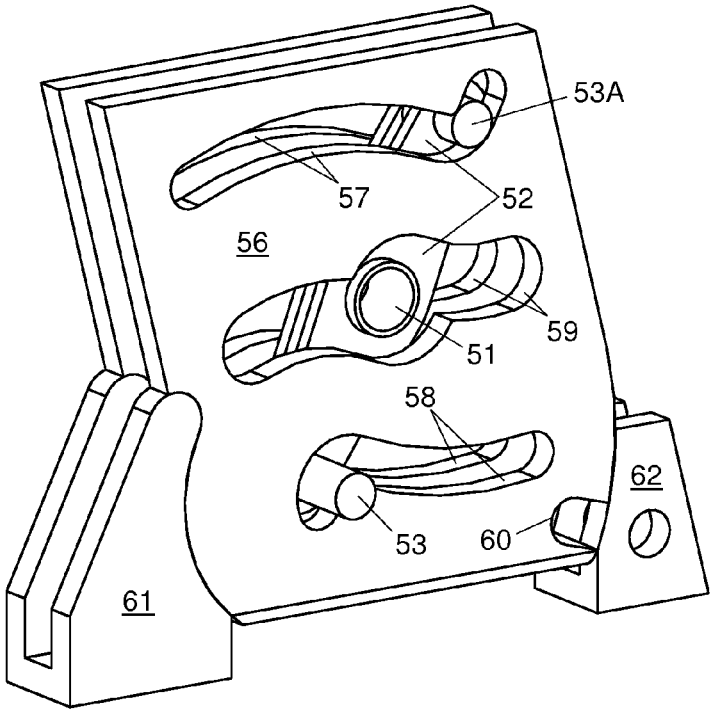
FIG. 2 is a perspective of a side-driven splitter at middle position.

FIG. 2 shows a side-loading splitter at middle position. Included are: a housing 56 with two slots 57, two slots 58, two center slots 59 and two positioning slots 60; internal members bushing 51, carrier 52, output pin 53, and idler pin 53A; and, a bookend 61 and its complement bookend 62 that are mounted to a cylinder head, or "deck" (not shown). Housing 56 is symmetric about a plane centered between and parallel to its largest faces. Output pin 53 is slidably mounted in slots 58, and idler pin 53A is slidably mounted in slots 57. Center slots 59 are shaped to allow bushing Slits full range of motion without contacting housing 56. Housing 56 is rotatably mounted between bookend 61 and bookend 62, the rotation centered at the displayed location of output pin 53. A lever (not shown) that pivots about a bore that goes through bookend 62, bears into positioning slots 60 to position housing 56 with respect to bookend 61 and bookend 62. The lever may be controlled by means known in the art, such as by a servomotor. Slots 57 and slots 58 are equal in shape and in relative position to slots 47 and slots 48, respectively, of FIG. 1.

Figure 3:
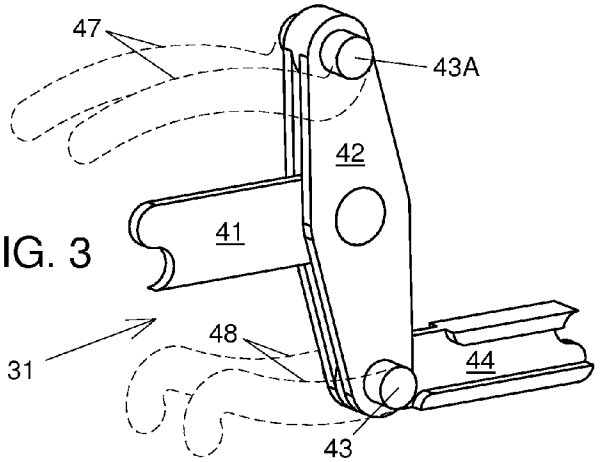
FIG. 3 is an isolated view of the FIG. 1 splitter.

FIG. 3 isolates selected members of FIG. 1, showing driver 41 pinned into a bore in carrier 42 midway between output pin 43 and idler pin 43A. Output pin 43 and idler pin 43A are parallel, each of which is fixed into its bore in carrier 42. Slots 47 and 48 are represented as outlines. Core 31 is members 42, 43, and 43A with 43 and 43A fitted into their slots 48 and 47, respectively. An end of arm 44 is sandwiched between inner faces of carrier 42 and pinned by output pin 43.

Figure 4:
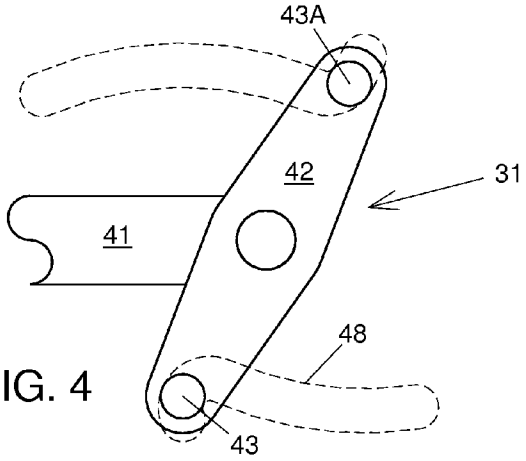
FIG. 4 is an isolated side view of the FIG. 3 members, at middle position.
Figure 5:
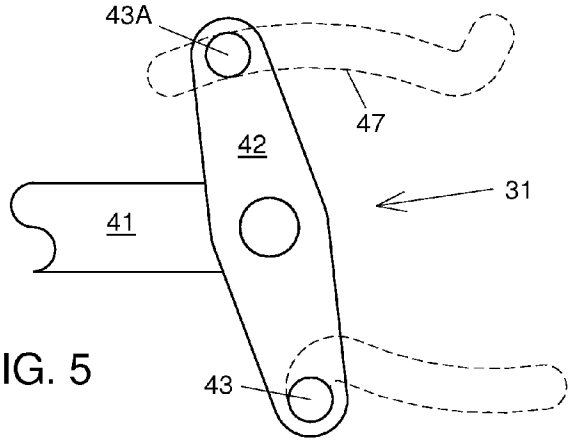
FIG. 5 is an isolated side view of the FIG. 3 members, at idle position.

FIG. 4 shows core 31 at middle position. FIG. 5 shows core 31 at idle position.

Figure 6:
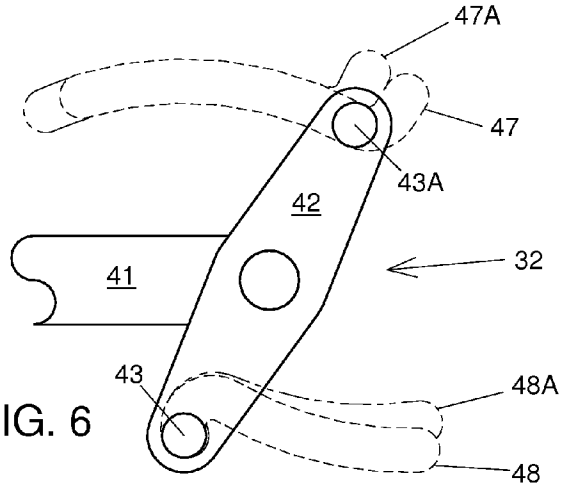
FIG. 6 is an isolated side view of the FIG. 3 members, at variable valve dwell (VVD) middle position.

FIG. 6 shows the members of core 31 with slots 47 and 48 rotated from their FIG. 1 positions, which are labeled ghost 47A and ghost 48A, respectively. The rotation of housing 46 that moves slots 47 and 48 takes place about the axis of disks 50, which coincides with that of output pin 43 in FIG. 4. The members of core 31, with slots 47 and 48 mounted in FIG. 6 configuration, become core 32. Core 32 is shown at middle position, the position laterally of driver 41 being equal to that of driver 41 in FIG. 4.

FIG. 7 is a comparison of carrier 42, carrier 52, and (from FIG. 9) a carrier 72. The three are equal in their bore-center geometry. Carrier 52 mounts bushing 51 so as to receive a cantilevered driving pin, and output pin 53 cantilevers its output. Carrier 52 is closed at both ends for greater torsional strength than that of carrier 42, which does not cantilever its output. Carrier 72 is shown mounting a lower pin 73 and an upper pin 74.

Side view FIG. 8 shows pertinent geometric details of core 31. The lateral motion range of driver 41 is indicated by an arrow, the arrow also indicating the direction in which driver 41 applies force to carrier 42. The surface normal contact plane of output pin 43 with slots 48 is indicated by a ray 64, and the surface normal contact plane of idler pin 43A with slots 47 is indicated by a ray 63. A half-plane that proceeds from the axis of the 41-42 pin and intersects the junction of ray 63 and ray 64 is indicated by a ray 65. The planes represented, respectively, by ray 64 and by ray 63 are indicated only in the direction of their intersection.

Figure 9:
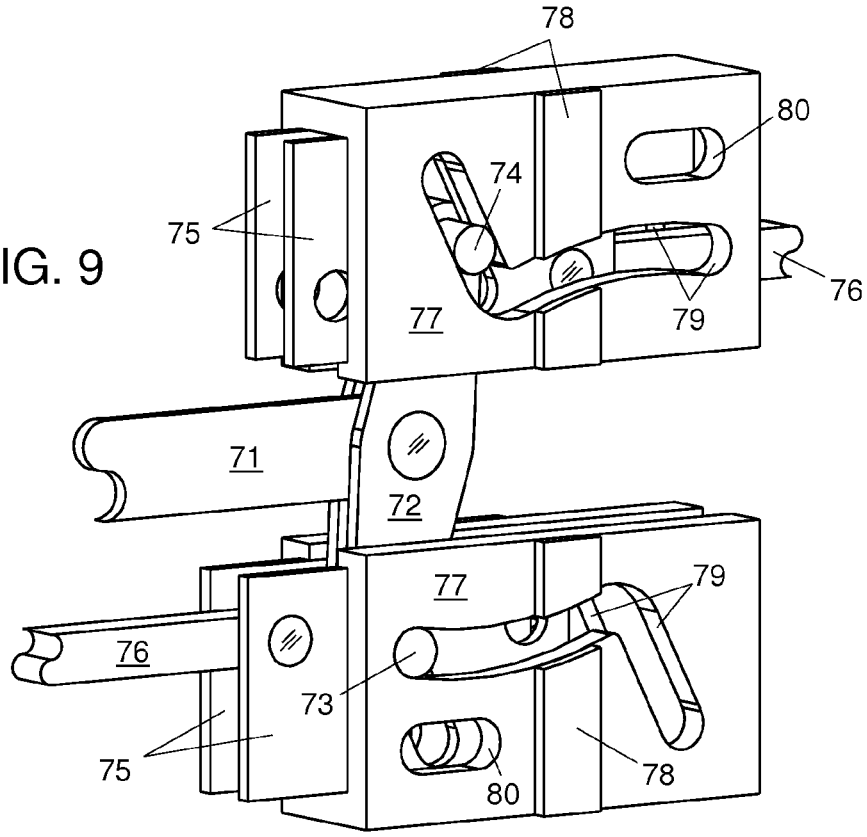
FIG. 9 is a perspective of a double-acting splitter at full lower output actuation.

FIG. 9 shows a double-acting splitter at full lower output actuation. Included are: two housings 77, each including two bosses 78, two slots 79 and a positioning slot 80; two plates 75 slidably mounted in each housing 77, each pair of plates 75 being coaxially pinned by an arm 76; and internal members driver 71, carrier 72, lower pin 73, and upper pin 74. Lower pin 73 is slidably mounted in slots 79 of the "lower" housing 77. Upper pin 74 is slidably mounted in slots 79 of the "upper" housing 77. Each pair of bosses 78 is parallel and fixed to its housing 77 on opposite faces. Housings 77 are mounted slidably in a frame (not shown) by their bosses 78, and positioned with respect to each other and the frame by a linkage (not shown) that engages positioning slots 80. The linkage may be controlled by means known in the art, such as by a servomotor. Each slot 79 includes a major portion that arcs about a position in its opposing (i.e. upper vs. lower) slot 79.

Figure 10:
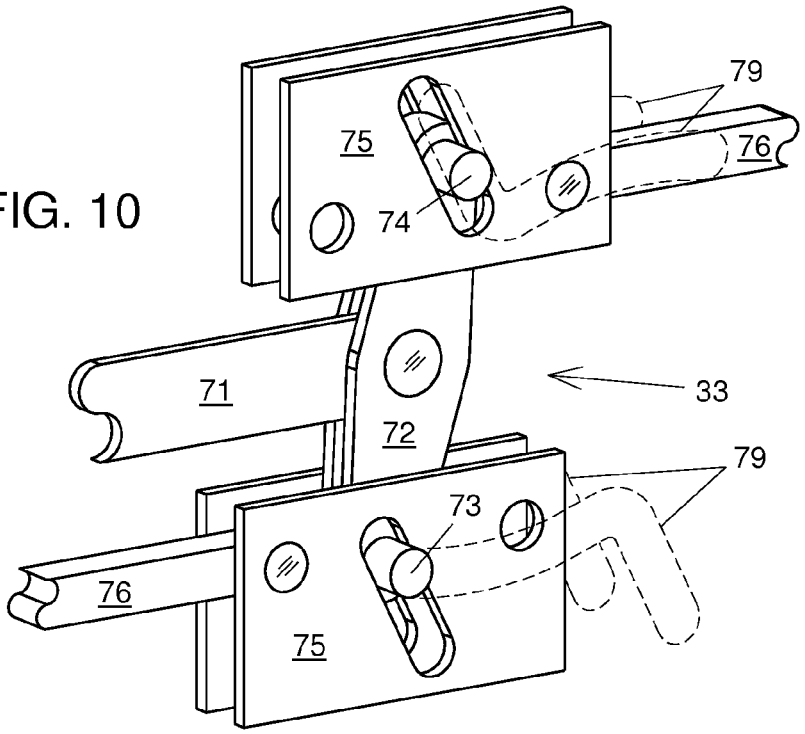
FIG. 10 is an isolated view of the FIG. 9 splitter.

FIG. 10 isolates selected members of FIG. 9, showing driver 71 pinned into a bore in carrier 72. Each of, lower pin 73 and upper pin 74, is fixed into its bore in carrier 72. Slots 79 are represented as outlines. Each plate 75 comprises a slot through which a lower pin 73 or an upper pin 74 is slidably fit, a portion of which slot is equal in shape to a portion of slots 79 into which, respectively, lower pin 73 or upper pin 74 is also fit. An empty bore through each plate 75 is shown that is the same size as the bore into which its arm 76 is pinned. Core 33 is members 71-76 with 73 and 74 fitted into their respective slots 79.

Figure 11:
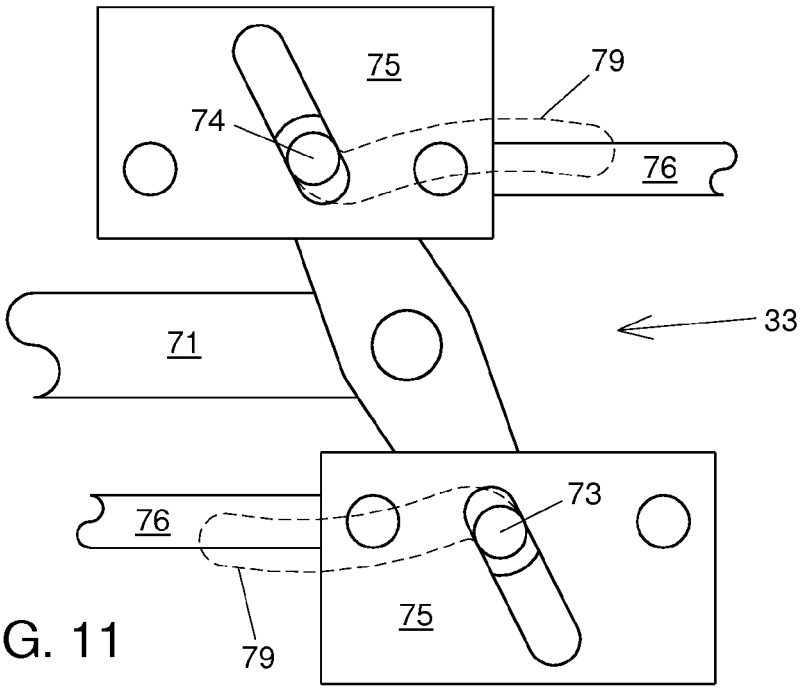
FIG. 11 is a side view of the FIG. 10 members, at middle position.
Figure 12:
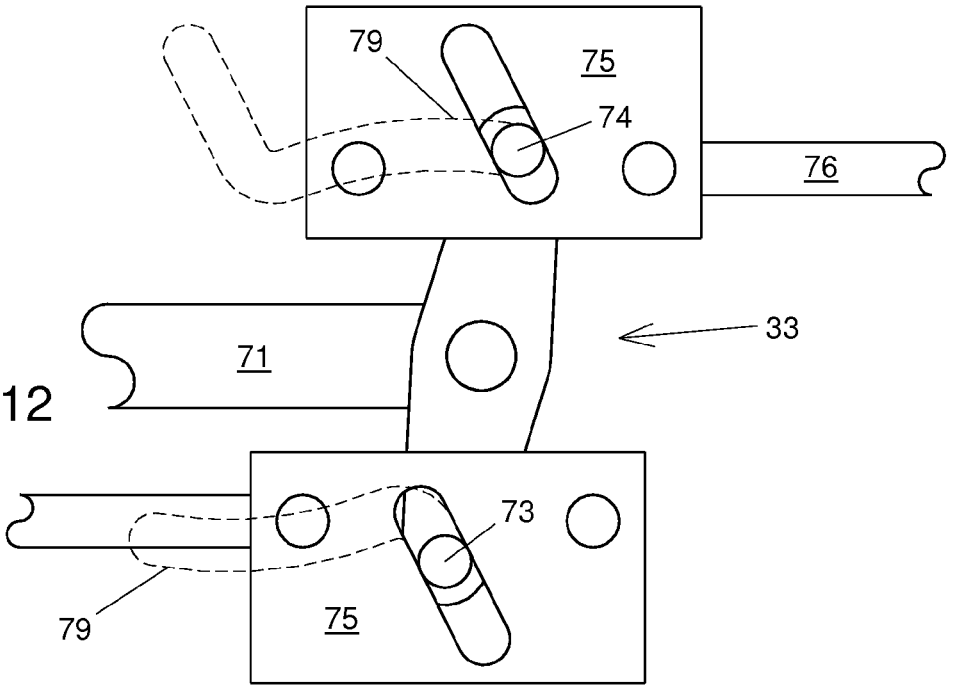
FIG. 12 is a side view of the FIG. 10 members, at full upper output actuation.

FIG. 11 shows core 33 at middle position. FIG. 12 shows core 33 at full upper output actuation.

Figure 13:
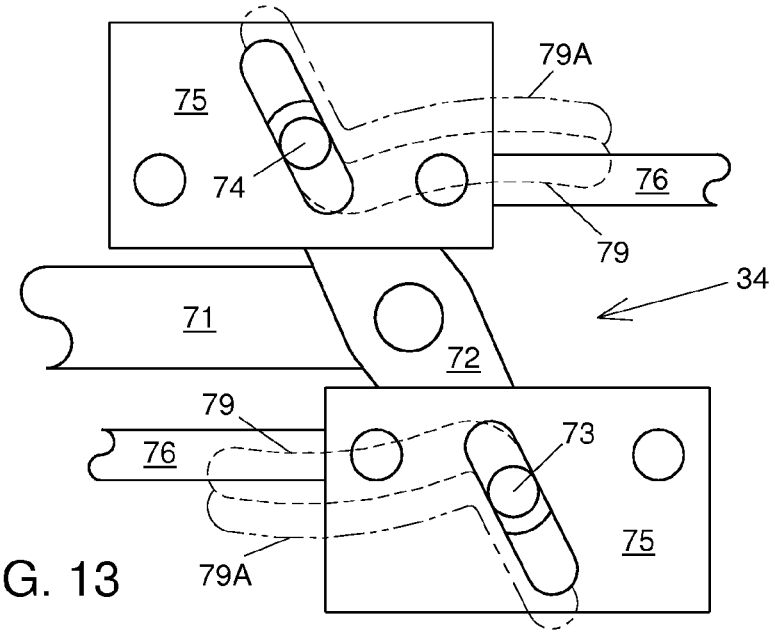
FIG. 13 is a side view of the FIG. 10 members, at VVD middle position.

FIG. 13 shows the members of core 33 with slots 79 translated from their FIG. 9 positions, which are labeled ghosts 79A. The translation of housings 77 that moves slots 79 is that which takes place along bosses 78. The members of core 33, with slots 79 mounted in FIG. 13 configuration, become core 34. Core 34 is shown at middle position, the position laterally of driver 71 being equal to that of driver 71 in FIG. 11.

Figure 14:
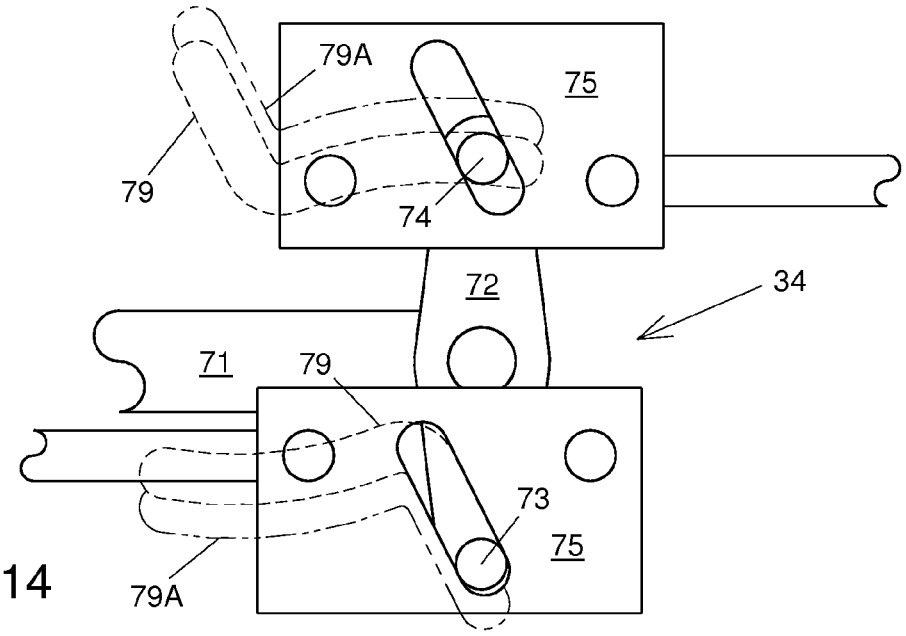
FIG. 14 is a side view of the FIG. 10 members, at VVD full upper output actuation.

FIG. 14 shows core 34 at full upper output actuation. The position laterally of driver 71 is equal to that of driver 71 in FIG. 12.

Figure 15:
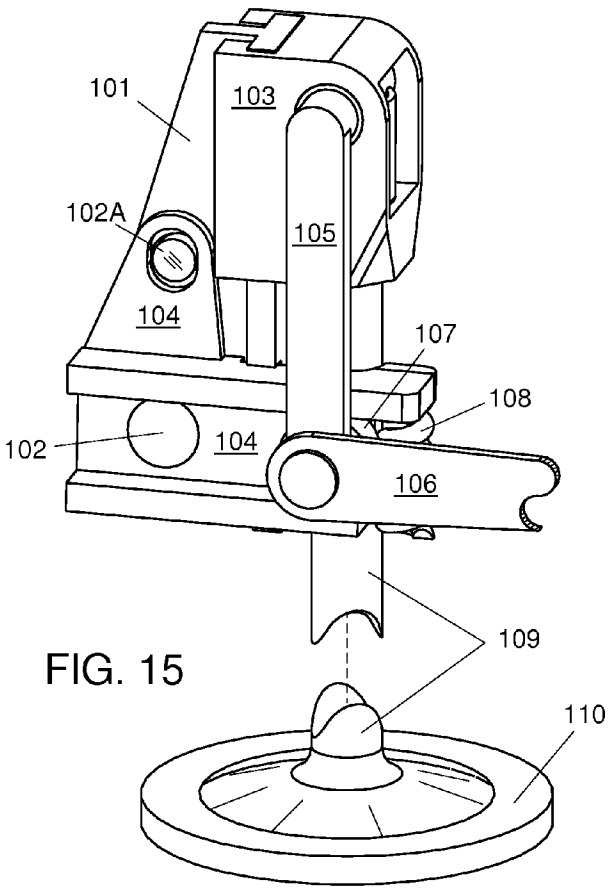
FIG. 15 is a perspective of a positive return valve actuator at valve-seated position.

FIG. 15 shows a positive return valve actuator assembly, at valve-seated position. A poppet valve 109 is seated in a valve seat 110 and retained in a cage 103 that is slidably mounted on a pylon 101. Pylon 101 is mounted to a deck (not shown) through which poppet valve 109 translates to ventilate an engine cylinder. Valve seat 110 is mounted into the cylinder's head. Cage 103 journals an hypotenuse 105 that journals a drive link 106 (shown abbreviated). Hypotenuse 105 also journals a roller 107 that is slidably mounted in a channel of a guide 104. Guide 104 is fixed to a dowel 102 that is journaled into pylon 101, and guide 104 is rotationally limited by a bench 102A mounted on pylon 101. A spring 108 seated on the deck urges guide 104 to abut bench 102A, but the seating of poppet valve 109 in valve seat 110 prevents the abutment and leaves lash between guide 104 and bench 102A.

Figure 16:
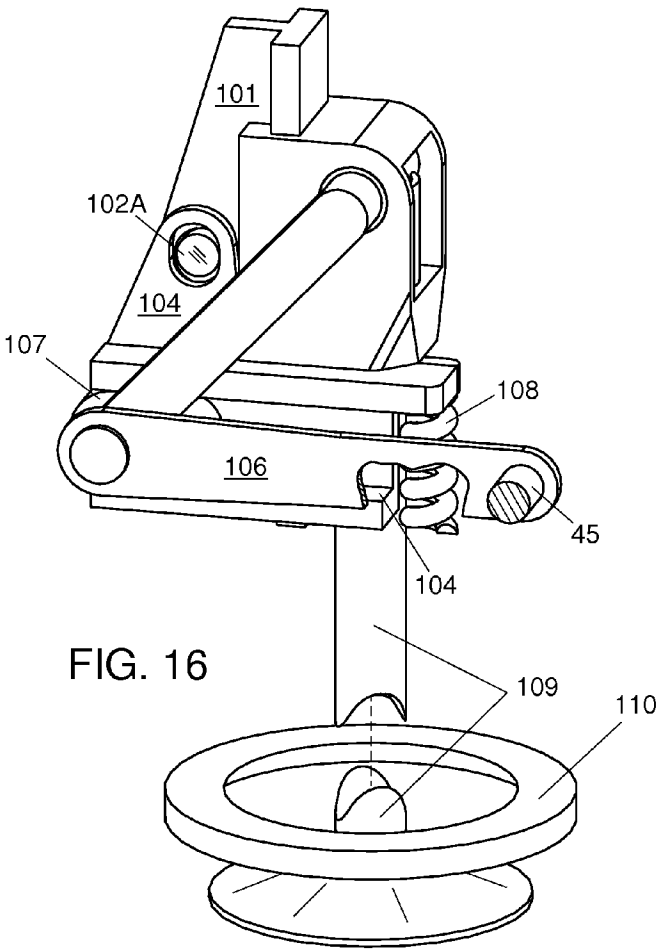
FIG. 16 is a perspective of the FIG. 15 actuator at valve-extended position.

FIG. 16 shows the valve actuator of FIG. 15, at valve-extended position. Drive link 106 is shown with one end having a bore into which a cantilever end of gudgeon 45 (FIG. 1) is journaled. Gudgeon 45 is guided in a frame slot (not shown) for substantially lateral movement. The middle portion of drive link 106 is shown partially cut-out to reveal detail of guide 104 and spring 108 behind it. Guide 104 abuts bench 102A under the urging of spring 108, and drive link 106 is at its full lateral position relative to FIG. 15.

Those skilled in the art will recognize that the actuator of FIGS. 15 and 16 is practicable also as a mirror image version of that shown. To thus configure the actuator allows its actuated direction to be laterally opposite that displayed. Cores 31B, 31D, 31E, and 31F (described with FIGS. 17 and 18) drive such mirror-image actuators.

Figure 17:
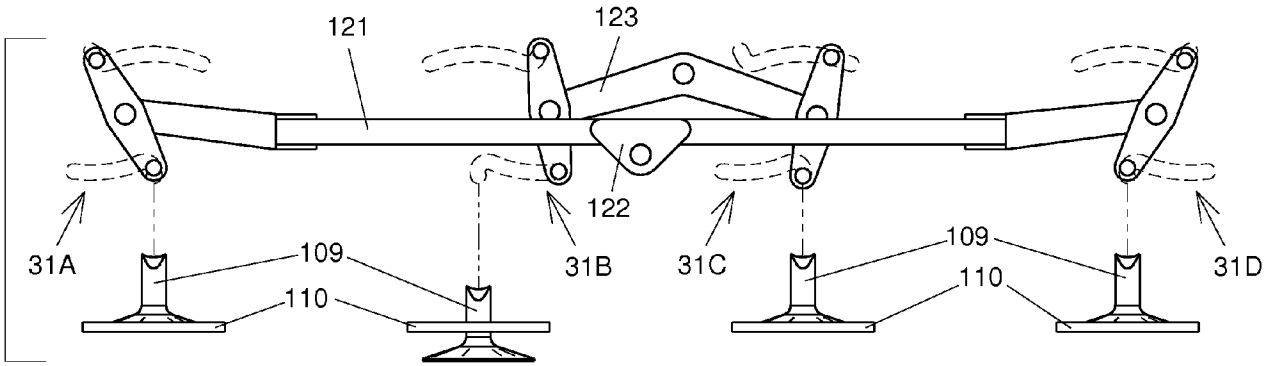
FIG. 17 is an isolated side view of an engine intake valve system.

FIG. 17 isolates members of an intake valve train, including poppet valves 109, of a four-cylinder engine. Poppet valves 109 are shown relative to their valve seats 110, three being seated and one being open. Poppet valves 109 and valve seats 110 are mounted as in FIG. 15. Operatively associated with each poppet valve 109 is an end-loading splitter represented by its core 31, the association indicated with a phantom line. The association is that detailed with FIGS. 1 and 16. Cores 31 are distinguished into cores 31A, 31B, 31C, and 31D and correspond to the first through fourth, respectively, cylinders to which poppet valves 109 pertain. A bridge 121 links carriers 42 of each of, cores 31A and 31D, and is driven through a drive gusset 122 that is part of it. Bridge 121 is offset, through its middle portion, from the plane of its linked carriers 42 so as to miss housings 46 (FIG. 1) belonging to cores 31B and 31C. A bridge 123 links carriers 42 of each of, cores 31B and 31C, and is driven through a bore in it. Bridge 123 is coplanar with its linked carriers 42. Bridge 121 and bridge 123 are driven by outside means (not shown).

Each core 31 "faces" in the direction that its actuation travels. Cores 31A and 31D face out from bridge 121, and cores 31B and 31C face in towards bridge 123. Bridge 121 is shown centered, cores 31A and 31D each at middle position. Bridge 123 is at its right extreme position, core 31B fully actuated and core 31C at idle position.

Figure 18:
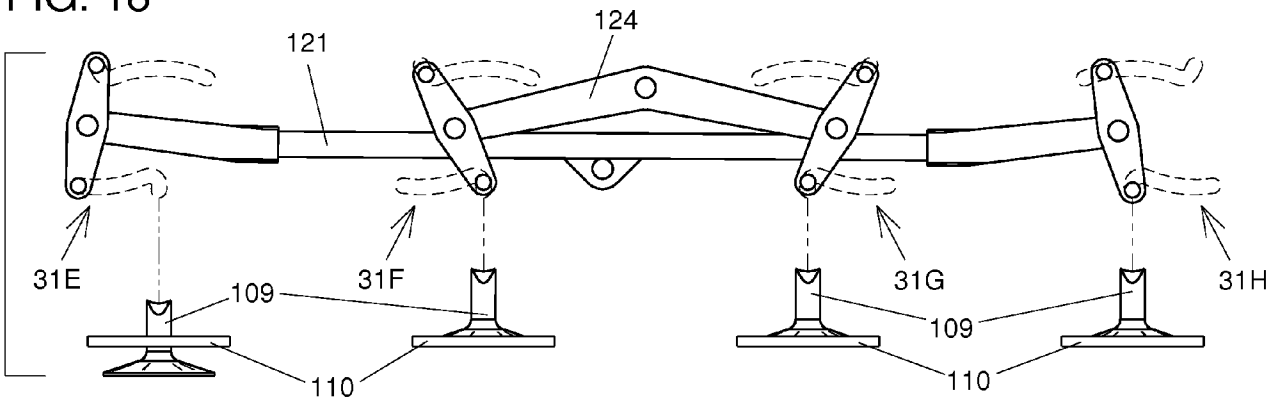
FIG. 18 is an isolated side view of an engine exhaust valve system.

FIG. 18 isolates exhaust valve train members, including poppet valves 109, of the four-cylinder engine of FIG. 17. Poppet valves 109 are shown relative to their valve seats 110, three being seated and one being open. Poppet valves 109 and valve seats 110 are mounted as in FIG. 15. Operatively associated with each poppet valve 109 is an end-loading splitter represented by its core 31, the association indicated with a phantom line. The association is that detailed with FIGS. 1 and 16. Cores 31 are distinguished into cores 31E, 31F, 31G, and 31H and correspond to the first through fourth, respectively, cylinders to which poppet valves 109 pertain. Bridge 121 links carriers 42 of each of, cores 31E and 31H, and is driven through its drive gusset 122. The offset portion of bridge 121 allows it to miss housings 46 belonging to cores 31F and 31G. A bridge 124 links carriers 42 of each of, cores 31F and 31G, and is driven through a bore in it. Bridge 124 is coplanar with its linked carriers 42. Bridge 121 and bridge 124 are driven by outside means (not shown).

Cores 31E and 31H face out from bridge 121, and cores 31F and 31G face out from bridge 124. Bridge 121 is at its left extreme position, core 31E fully actuated and core 31H at idle position. Bridge 124 is shown centered, cores 31F and 31G each at middle position.

Operation

A driver's reciprocating motion is transformed into one portion that actuates an output member and one portion that leaves the output member inactive. The output member can, for example, operatively actuate a "valve station" (i.e. one or more valves of like function in one cylinder) on an internal combustion engine. The driver can be actuated by various means, for instance: mechanically, by a cam and follower system; hydraulically, according to a timed relationship with the engine crankshaft; or electromechanically. The actuation means of a driver is that driver's "source."

In one embodiment, the driver has "short", "middle", and "long" positions through which it reciprocates. Its output member is substantially inactive throughout short position, substantially inactive at middle position, and is actuated within long position. During actuation of the output member its output speed is roughly twice that of the driver. In a typical installation the driver simultaneously drives two instances of the embodiment oppositely, such that their respective output members are actuated alternately. In such an installation, one driver actuates two valve stations on an engine.

A first pin and a second pin parallel to each other are mounted in a carrier. The first pin is slidably mounted in a first slot and the second pin is slidably mounted in a second slot. The first and second slots are established into position with respect to one another. The carrier is itself positioned by a reciprocating driver. A "pin radius" is the distance between the axes of the first and second pins. Each pin in its slot has a surface normal contact plane with that slot. The intersection of the surface normal contact planes of, respectively, the first and second pins defines a "momentary rotational axis" for the carrier. A pin is "captured," or in its "capture," when the carrier's momentary rotational axis is within one-fourth of the pin radius from that pin. An exact capture of a pin is when the momentary rotational axis of the carrier coincides with that pin's axis. A pin sliding along its slot is in "traverse" of that slot. For a given lateral position of the driver with respect to the slots in which the pins slide, there is only one possible response of the first and second pins to that position.

FIG. 1 shows the end-driven splitter, with output pin 43 linked through arm 44 to gudgeon 45. Driver 41 is at long position, driving carrier 42.

FIG. 2 shows the side-driven splitter with bushing 51 at middle position, ready to receive a cantilever linkage from a driver. Output pin 53 is cantilevered through one side of housing 56. The side-driven splitter and the end-driven splitter have equal sliding-contact geometries and function equally, the distinction being that the side-driven splitter can be driven from, and can output to, its side.

In FIG. 3 output pin 43 is fully actuated, with its linked arm 44. Output pin 43 traverses slots 48, with idler pin 43A exactly captured in slots 47 and remaining captured, until driver 41 approaches its middle position (FIG. 4). At middle position, idler pin 43A is drawn down somewhat in its slot and output pin 43 is settled towards its capture in slots 48. As driver 41 moves further, towards the short position of FIG. 5, output pin 43 becomes exactly captured as idler pin 43A traverses to its farthest idle position, at which position a portion of slots 47 remains unused.

In FIG. 6 driver 41 is at middle position but slots 47, in which idler pin 43A slides, have been rotated from ghost 47A. Until driver 41, going long of its middle position, causes output pin 43 to leave its exact capture and idler pin 43A to approach its own capture, output pin 43 remains substantially inactive. Comparing core 32 with core 31 of FIG. 4, in core 32 driver 41 must be farther past middle position for output pin 43 to be substantially actuated. Since the actuation range in core 32 is thus truncated, and the driver reciprocates without change, the actuation period ("dwell") of its output is shortened. Applying the output to operatively actuate a valve station yields a variable valve dwell (VVD) according to the rotational position of slots 47. This VVD is stepless, which is to say that it can be applied incrementally.

To ensure that the end-loading splitter does not "stall," which is to say that it attempts an impossible action, assessment geometry is shown in FIG. 8. Ray 63 and ray 64 converge with ray 65. A momentary rotational point of idler pin 43A with respect to slots 47 lies anywhere along ray 63, since ray 63 is on the surface contact normal between idler pin 43A and slots 47. Similarly, any point along ray 64 serves as a momentary rotational point for output pin 43 with respect to slots 48. To coincidently rotate idler pin 43A and output pin 43, the intersection of ray 63 and ray 64 is required and is thus on the momentary rotational axis for carrier 42. As long as the tangent of a "critical" angle, which is to say the angle between ray 65 and the force applied from driver 41 to carrier 42, is not zero the embodiment will not stall. As drawn, the tangent of the critical angle is apx −0.64 and never approaches zero. Hence, the embodiment will not stall.

The double-acting splitter of FIG. 9 alternately actuates two arms 76 by way of one driver 71. The geometry of slots 79 is established, in the same manner as that described with FIG. 8, such that throughout the double-acting splitter's operating range stalling does not occur. Driver 71 is shown at the left extreme of its reciprocation. Upper pin 74 is exactly captured in its slots 79, and lower pin 73 is fully actuated with its linked plates 75 and arm 76.

FIG. 10 shows upper pin 74 in the "same-shape" section of its slots 79, which section is shaped the same as a portion of the slot in plate 75. While in this section, upper pin 74 allows its linked arm 76 no motion and upon traversing from it, actuation of arm 76 is begun. The unused bore in each plate 75 can be used to journal its arm 76 in the direction laterally opposite to that shown, thus allowing the double-acting splitter greater layout flexibility.

In FIG. 11 driver 71 has moved to middle position, traversing lower pin 73 into the same-shape section of its slots 79. Upper pin 74 is also in the same-shape section of its slots 79 and thus, both arms 76 are inactive. The embodiment acts "symmetrically," which is to say that the actuation of the upper arm 76 for a given displacement of driver 71 from middle position is equal to the actuation of the lower arm 76 for an equal and opposite displacement of driver 71 from middle position. FIG. 12 shows driver 71 moved to the right extreme of its reciprocation, with lower pin 73 exactly captured and upper pin 74 fully actuated with its linked plates 75 and arm 76.

In FIG. 13 the positions of slots 79 have been translated from their respective ghosts 79A. Driver 71 is at middle position and lower pin 73 and upper pin 74 are inactive, in their same-shape sections of their respective slots 79. Comparing core 34 with core 33 of FIG. 11, in core 34 driver 71 must be farther right of middle position for upper pin 74 to actuate its linked arm 76. Since the actuation range in core 34 is thus truncated, and the driver reciprocates without change, its dwell is shortened. Hence, the output dwell of core 34 is less than that of core 33 and the double-acting splitter is capable of VVD. Driver 71 actuates arms 76 linked to core 34 symmetrically.

FIG. 14 shows core 34 with its driver 71 at the right extreme of its reciprocation, and it is to be noted that upper pin 74 is not as far laterally as in FIG. 12. This is due partly to the capture location of lower pin 73 being lower in its same-shape slot than in FIG. 12.

To portray one of many possible usage modes of the present disclosure, a kinetically unyielding statically compliant ("KUSC") positive return valve actuator is introduced in FIGS. 15-16. An end-loading splitter is linked to drive it. The KUSC actuator shown is according to my U.S. patent application Ser. No. 13/678501.

Hypotenuse 105 is driven by drive link 106, which itself is driven by gudgeon 45. Roller 107, journaled on hypotenuse 105, rolls or slides along the channel of guide 104. With poppet valve 109 seated in valve seat 110 and overdriven by gudgeon 45, an overtravel condition results within the KUSC actuator. Guide 104 responds to this overtravel by rotating with dowel 102 to allow lash between guide 104 and bench 102A (FIG. 15). This lash is forcibly opposed by spring 108. The force from spring 108, linked through hypotenuse 105 and cage 103, seats poppet valve 109 in valve seat 110. As drive link 106 moves between its FIGS. 15 and 16 positions, guide 104 contacts bench 102A and poppet valve 109 is lifted from valve seat 110. Cage 103 slides along pylon 101, moving poppet valve 109 to its most-extended position, completing the valve lift. Gudgeon 45 then returns the KUSC actuator towards its valve-seated position. As the valve seats, lash once again appears between guide 104 and bench 102A and spring 108 again forcibly seats poppet valve 109 in valve seat 110.

At FIG. 15 position, modest lateral movement of hypotenuse 105 is tolerated without its unseating poppet valve 109. The side-loading splitter (FIG. 1) effects some play to its gudgeon 45 between middle position and the exact capture of output pin 43. The amount of play effected is small compared to that tolerated by the KUSC actuator, and results from the splitter's geometry that actuates gudgeon 45 somewhat abruptly as driver 41 moves long of middle position. The splitter can be designed without the play but by the tolerance of the KUSC actuator for such, the valve's initial lift can be more aggressive.

End-loading splitters operatively position intake and exhaust valves of an internal combustion engine in, respectively, FIGS. 17 and 18. Bridges 121 drive their outward-facing core 31 pairs. Bridge 123 drives its inward-facing core 31 pair, and bridge 124 drives its outward-facing core 31 pair. The facings of these pairs anticipates the employment of an axial cam and follower system such as that in the Foertsch patent to drive bridges 121, bridge 123, and bridge 124. Timing of such a layout requires that at least one pair of splitters be faced oppositely to the other pairs.

One source drives bridge 121 and one other source drives bridge 123 in FIG. 17. When bridge 121 actuates one splitter, the other of its splitters is idled. Similarly, with bridge 123 actuation of one of its splitters idles the other of its splitters. Thus, two intake-sources drive all four intake valves for the engine.

One source drives bridge 121 and one other source drives bridge 124 in FIG. 18. When bridge 121 actuates one splitter, the other of its splitters is idled. Similarly, with bridge 124 actuation of one of its splitters idles the other of its splitters. Thus, two exhaust-sources drive all four exhaust valves for the engine.

The traverse paths of the pins in the splitters disclosed have arced portions, so that the captured pin does not move unnecessarily in operation. But there is no requirement that the traverse paths be arced: an arced portion that results in an exact capture can instead, for instance, be made as a straight portion that allows a captured pin to move slightly in operation. Additionally, the pins themselves can be allowed to rotate in their mountings to reduce friction on their contact surfaces under load.

The embodiments described in this specification are for the purposes of disclosure and not to be taken as limiting the present disclosure as defined in the claims.

I claim:

1. A splitter that receives a reciprocating input from a driver and actuates an output, in which said splitter: a first pin, a second pin, and a midpin that are substantially parallel are mounted on a carrier; the first pin is slidably mounted in a first slot that is established on a housing and the second pin is slidably mounted in a second slot that is established on a housing; the first slot and the second slot are positioned with respect to one another; the driver is linked to the midpin and the first pin is linked to actuate the output; each position of the driver determines a corresponding position of each of, the first pin and the second pin; and the first pin is captured at one reciprocal end of the driver's stroke and the second pin is captured at the other reciprocal end of the driver's stroke; whereby the driver actuates the output through a portion of the driver reciprocation.

2. The splitter of claim 1 wherein the operating position of at least one of, the first slot and the second slot, is variable such that with the driver reciprocation remaining constant, the duration of the actuation of the output is variable.

3. The splitter of claim 1 wherein the second pin is linked to actuate an additional output.

4. The splitter of claim 1 further including a substantially equivalent splitter linked to it such that both splitters share one driver and are oriented so as to actuate their respective outputs alternately.

5. A splitter that receives a reciprocating input from a driver and operatively actuates a valve of an internal combustion engine, in which said splitter: a first pin, a second pin, and a midpin that are substantially parallel are mounted on a carrier; the first pin is slidably mounted in a first slot that is established on a housing and the second pin is slidably mounted in a second slot that is established on a housing; the first slot and the second slot are positioned with respect to one another; the driver is linked to the midpin and the first pin is linked to operatively actuate the valve; each position of the driver determines a corresponding position of each of, the first pin and the second pin; a traverse of the first pin effects a capture of the second pin; a traverse of the second pin effects a capture of the first pin such that during a portion of the traverse of the second pin, the valve is substantially stationary; whereby the driver actuates the valve for a portion of the driver's reciprocation.

6. The splitter of claim 5 wherein the operating position of at least one of, the first slot and the second slot, is variable such that with the driver reciprocation remaining constant, the duration of the actuation of the valve is variable.

7. The splitter of claim 5 wherein the second pin is linked to operatively actuate an additional valve.

8. The splitter of claim 5 further including a substantially equivalent splitter linked to it such that both splitters share one driver and are oriented so as to operatively actuate their respective valves alternately.

9. A method of receiving a reciprocating input from a driver to operatively actuate a valve of an internal combustion engine, comprising the steps of: providing a splitter in which a first pin, a second pin, and a midpin that are substantially parallel are mounted on a carrier, the first pin is slidably mounted in a first slot that is established on a housing and the second pin is slidably mounted in a second slot that is established on a housing, the first slot and the second slot are positioned with respect to one another, the driver is linked to the midpin and the first pin is linked to operatively actuate the valve, and each position of the driver determines a corresponding position of each of, the first pin and the second pin; establishing that a traverse of the first pin effects a capture of the second pin; and establishing that a traverse of the second pin effects a capture of the first pin such that during a portion of the traverse of the second pin, the valve is substantially stationary; whereby the driver actuates the valve for a portion of the driver's reciprocation.

10. The method of claim 9 further including the step of varying the operating position of at least one of, the first slot and the second slot, and thus varying the duration of the actuation of the valve with the driver reciprocation remaining constant.

11. The method of claim 9 further including the step of linking the second pin to operatively actuate an additional valve.

12. The method of claim 9 further including the step of linking to the splitter of claim 9 a substantially equivalent splitter such that both splitters share one driver and are oriented so as to operatively actuate their respective valves alternately.

* * * * *